US005632071A

United States Patent [19]

Maunder

[11] Patent Number: 5,632,071

[45] Date of Patent: May 27, 1997

[54] FLEXIBLE HINGE CONNECTOR

[76] Inventor: Martha Maunder, Box 2990 Fourth Street Station, St. Petersburg, Fla. 33731

[21] Appl. No.: 456,543

[22] Filed: Jun. 1, 1995

[51] Int. Cl.[6] ..... A41F 1/00; A44B 11/00

[52] U.S. Cl. ..... 24/573.7; 24/573.1

[58] Field of Search ..... 24/573.7, 573.1, 24/573.3, 33 P

[56] References Cited

U.S. PATENT DOCUMENTS

| | | | |
|---|---|---|---|
| 376,702 | 1/1888 | Bayer . | |
| 481,207 | 8/1892 | Smith . | |
| 487,939 | 12/1892 | Smith . | |
| 715,516 | 12/1902 | Sessions | 24/573.7 |
| 1,681,958 | 12/1928 | Stevenson . | |
| 1,801,559 | 4/1931 | Kellogg . | |
| 3,103,050 | 9/1963 | Reitmeier | 24/573.7 |
| 3,324,991 | 6/1967 | Voss | 24/33 P |
| 3,426,397 | 2/1969 | Redden | 24/573.7 |
| 3,460,282 | 8/1969 | Swirsky | 24/573.1 |
| 3,698,045 | 10/1972 | Redden | 24/573.7 |
| 4,218,047 | 8/1980 | Douglas | 24/573.1 |
| 4,231,135 | 11/1980 | Fradin . | |
| 4,719,788 | 1/1988 | Musil . | |
| 5,182,933 | 2/1993 | Schick . | |

FOREIGN PATENT DOCUMENTS

| | | | |
|---|---|---|---|
| 0747511 | 10/1944 | Germany | 24/573.7 |
| 0831725 | 3/1960 | United Kingdom | 24/573.7 |

*Primary Examiner*—Victor N. Sakran

[57] ABSTRACT

A flexible hinge connector, and method for making same is provided comprising a hinge having flange and loop portions constructed out of flexible, planar material, and a loop connector which may comprise flexible, compressible material, thereby allowing the flexible hinge connector to compress and deform without damage. The flexible hinge connector allows flexible objects to be hingedly connected without a rigid hinge. The flexible hinge connector may also be seamlessly incorporated into such objects.

12 Claims, 15 Drawing Sheets

FIG. 23
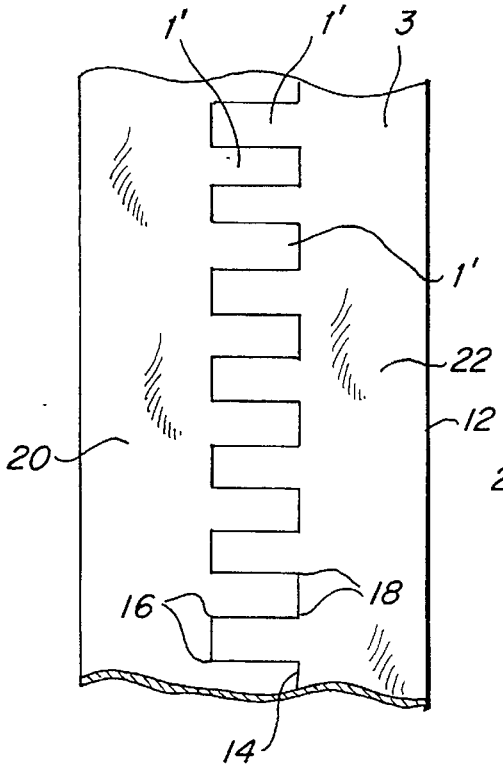
FIG. 24
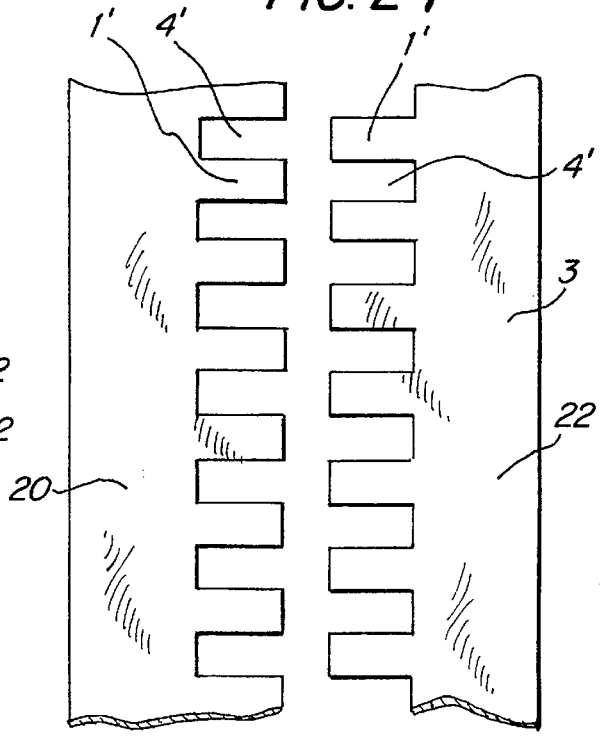
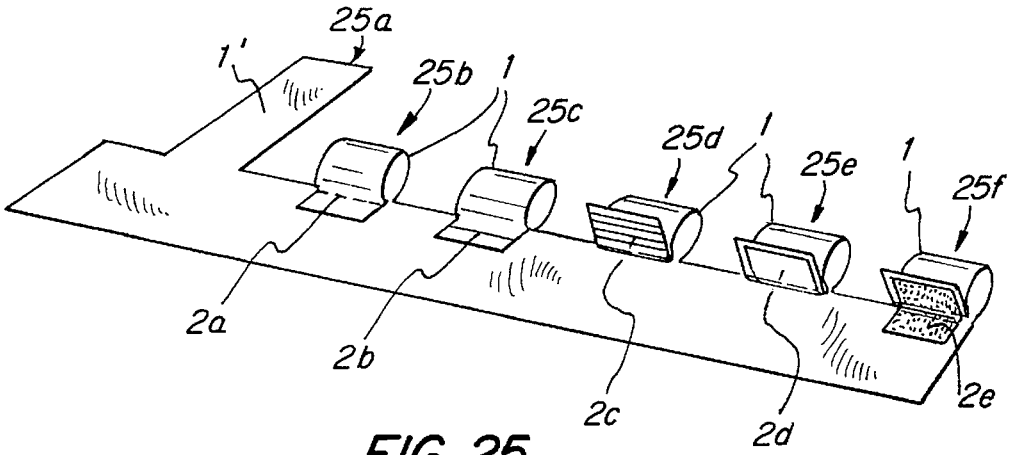
FIG. 25

FLEXIBLE HINGE CONNECTOR

The invention relates to hinges, connectors and fasteners and more specifically to an improved flexible hinge-type connector suitable for manufacture in any pliable planar material for use in numerous new and important consumer and industrial applications.

BACKGROUND OF THE INVENTION

Hinges have been and are now primarily fabricated of metals for use on rigid materials in the form of doors, windows, furniture and other products. However, metal hinges are not suitable to connect fabric, vinyl, rubber, paper, leather and the myriad of other natural and synthetic flexible planar materials.

Metal hinges are heavy and require a costly, resource and labor-intensive chain of production processes to manufacture.

Metal hinges corrode and rust, particularly in moist environments. Stainless steel is less corrosive, but substantially more expensive.

Means of attachment of metal hinges to another material or product is limited primarily to the use of metal fasteners such as screws and nails or by direct welding, thus effectively limiting the types of material to which metal hinges may be attached. That is, to other metals, wood, and dense plastics.

Metal piano-style hinges more specifically are costly, not generally available or practical in lengths over eight feet, and most have fixed pins, disallowing the separation of the right and left side flanges from each other. Also, piano-style hinges are not resilient. Should one get bent or folded, it is difficult to return to its original form without damage.

An elongated plastic hinge is disclosed by U.S. Pat. No. 4,231,135 to Fradin, however this hinge is limited to extruded plastic with an extruded cylindrical tubular plastic hinge pin and optional additional rod, also of plastic material.

Manufacture of the Fradin hinge is limited to the use of only one material, extruded plastic, throughout the product, with no provision for layering, embossing, or other structural or aesthetic coupling of like or dissimilar materials.

While the Fradin hinge is flexible, due to the described process of extrusion, it maintains a semi-rigid state when assembled. This, in turn, imposes that rigidity upon the host material or product and limits the application of said hinge to materials compatible with the weight, rigidity, and structure of extruded plastic. Specifically, the Fradin extruded hinge would not be suitable for attachment to most materials lighter in weight or thinner in thickness than itself. For example, many fabrics, plastics, paper and others.

The Fradin hinge is described as sewable. However, the sewing of extruded plastic is realistically limited to industrial machines and not suitable for hand sewing applications. This factor substantially reduces the end uses, users and applications.

The Fradin hinge, with only a single plane flange on either side, can not be attached to a host material or product by enveloping a plane of host material on each of its two surfaces for purposes of added strength, aesthetic symmetry or other purpose.

Fradin and prior art hinges fail to offer material content or physical property options for linear connecting pins and rods other than a like-material tubular extrusion or solid cylindrical rod: metal hinges have metal pins and Fradin's plastic hinge has an extruded plastic tube and rod.

Accordingly, the assembled prior art hinges produce an unyielding cross-section. That is, they are incapable of a flatter relief than the diameter of the rigid tubular knuckles.

Color-matching the Fradin hinge to a solid color material or product to which it is being attached requires custom compounding of plastic pigment prior to extrusion. This is a costly and complicated process and involves purging the extrusion mold after each color. Also, to produce very bright, saturated colors requires a high concentration of pigment which increases cost and may render certain plastics more brittle.

The Fradin hinge, also due to production by extrusion is not capable of being produced in prints or patterns. For example, the same print or pattern as a host material or product.

Fradin and other prior art hinges must be produced separately, then affixed to a second material or product with no provision for the hinge connector being built into the pattern of the end product.

Hinges in present use are unsuited to the option of using only one side of the hinge as a connector. That is, using one side of flange and loops to connect to another product or material.

Although the Fradin hinge embodies a degree of flexibility, a length of several yards would not be capable of, for example, being folded without permanent damage.

Therefore, it is an important object of the present invention to provide an improved flexible hinge connector which satisfies long-felt but as yet unsolved needs and which obviates the aforedescribed disadvantages of the prior art.

SUMMARY OF THE INVENTION

What is desired therefore is a flexible hinge connector which may be manufactured from flexible materials, folded without permanent damage, optionally formed simultaneously with and as an integral part of the object being connected, and which may be compressed.

Equally important objects of the invention are:

(a) to provide improved flexible hinge connectors, manufactured simply and economically, from woven and non-woven, natural and synthetic content fabric, plastic, vinyl, rubber, paper, leather, compressed fiber, spunbonded olefin, neoprene, nylon, polypropylene, mesh, webbing and any other suitable material.

(b) to provide a flexible hinge connector wherein the loops of two opposing sides can be interconnected and kept in alignment by a variety of rigid and flexible means including but not limited to: a length of cord, rope, rubber, plastic, leather, webbing, fabric or elastic; a wood dowel; a metal tube or rod; a spring; a plastic tube or rod.

(c) to provide a method of producing an improved flexible hinge connector simply and economically, in numerous flexible materials, for use in new and important consumer and industrial applications. These include, but are not limited to: medical and surgical products; apparel and footwear; marine, boating and water sports equipment; home furnishings, drapery and upholstery; space travel, military, fire-fighting and police equipment; environmental and agricultural products; building construction products; toys, sports, camping and recreational equipment; travel, shipping, storage, and transportation equipment; office products and supplies; display fixtures, modular exhibit display systems; tents, awnings, flags, banners, and signage.

Surprising, new and unexpected results can be achieved by manufacture of the hinge invention in flexible materials.

For example, the improvement of a commonly-used medical device. This device is intended to reduce trauma and irritation caused to the skin and wound by repeated application and removal of medical tape used to secure dressings. Presently, the device used requires a shoe-lace-type stitching procedure each time a wound dressing is attended to. This cumbersome process may tend to provoke medical personnel to close the device by quicker, but less sanitary or secure means. Also, the shoe-lacing action when it is done, can put uncomfortable and damaging stress-pull on skin, stitches, scar tissue, or the securing adhesive.

Incorporating the improved flexible hinge connector as the closure for this device would obviate the above problems, thus improving the comfort and welfare of patients and the performance of health care professionals.

(d) to provide a method of producing flexible hinge connectors which can be composed of two or more layers, plies, laminations or embossments of like or dissimilar materials. This unique feature can increase: strength; compatibility to other materials; water repellency; buoyancy; fire retardancy; heat, pest, mildew, chemical, ultraviolet or other resistance; aesthetic appearance; any combination of the above or combination of other effects accomplished by a multiple-ply composition.

(e) to provide a hinge connector with improved flexibility and which obviates the imposed rigidity disadvantage embodied in prior art.

The improved flexible hinge provides new and important applications for connecting the thousands of existing flexible planar materials to other like or dissimilar materials.

The increased flexibility of the flexible hinge invention is particularly important in, but not limited to uses such as: medical dressings, apparel, home furnishings and upholstery, where a soft, supple connector may be desired.

(f) to provide a method of producing flexible hinge connectors such that they may be an integral part of a product or material without being produced independently first and then subsequently affixed to said product or material.

(g) to provide a method or methods of producing hinge connectors which can be easily sewn to a host material or product by hand stitching. This is in addition to alternate optional methods such as: machine sewing, heat-sealing or heat activated tape, adhesives or adhesive tape, hook and loop fasteners, staples, nails, screws and other fasteners and means.

(h) to provide a flexible hinge connector capable of being produced from the same or a coordinating material as that to which it is being attached such as a print fabric, a dyed leather, a recycled content material such as spunbonded olefin or other material.

(i) to provide a flexible hinge connector capable of being produced by the process of weaving in: patterns, colors, sizes, material content combinations, or multiple plies.

(j) to provide a flexible hinge connector capable of being rolled, for example: 1) on a spool of hundreds or thousands of yards or 2) in pre-cut, packaged lengths of, for example, 5 yards, 1 yard or other increments, (k) to provide a flexible hinge connector capable of being cut or woven in a variety of sizes simultaneously from a width of planar material.

(l) to provide a hinge connector capable of, when desired, enveloping two sides of a plane of host material for improved strength, aesthetic symmetry or other purpose.

(m) to provide a flexible hinge connector capable of being made from materials which dissolve or degrade over a period of time. For example, a material used in medical procedures that dissolves into or off of the body. Another example would be materials used in environmental or agricultural applications where biodegradability is desired after a period of time.

The above objects, features and advantages of the invention will become more readily apparent from the following description, reference being made to the accompanying drawings in which:

DETAILED DESCRIPTION OF THE DRAWINGS

FIG. 1 is a perspective view of a section of the improved flexible hinge connector composed of two plies, laminations or embossments.

FIG. 1*a* is a perspective view of the flexible hinge of FIG. 1 showing the method of folding a length of planar material containing regularly spaced apertures along line A—A and securing the circumference of the resulting loops along line B—B with a method and substance suited to the material.

Figure 1:
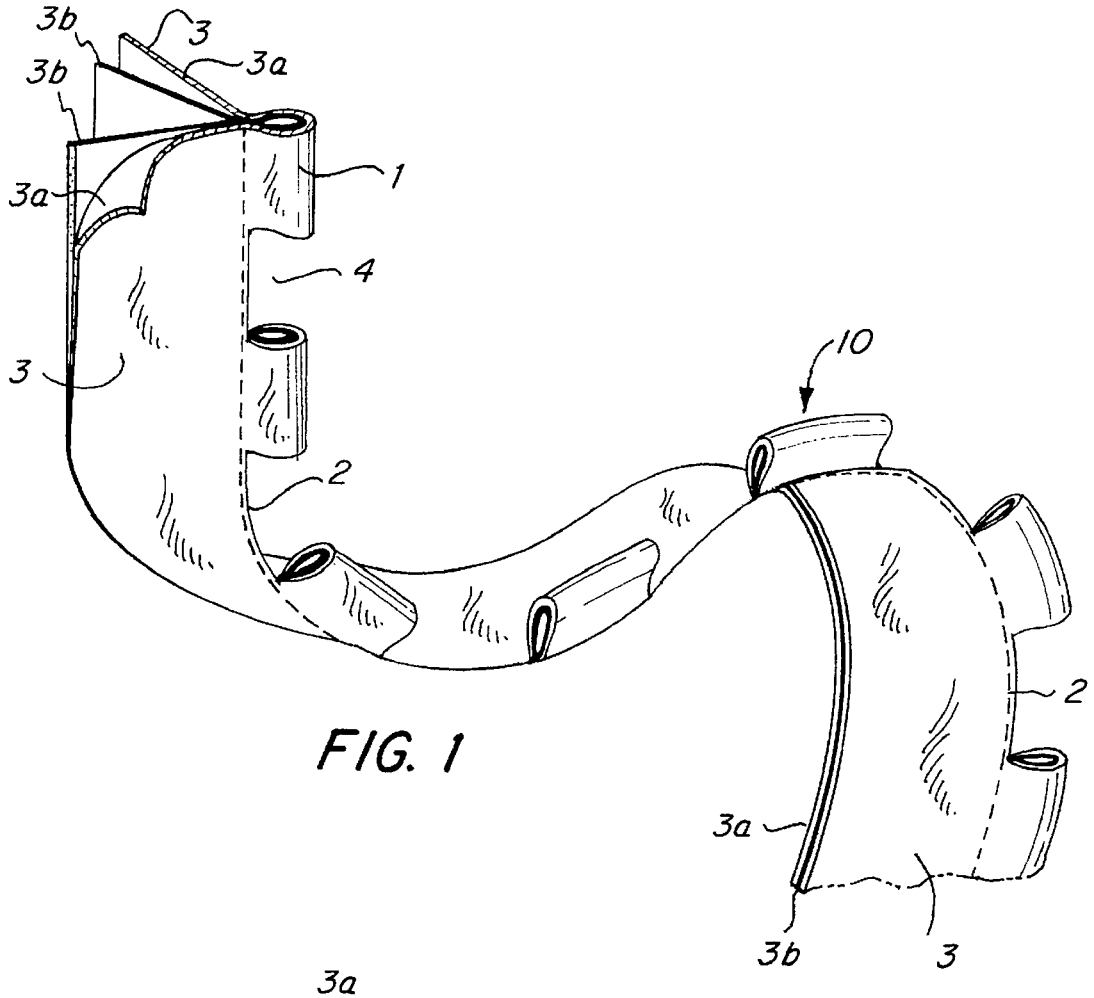
Figure 10:
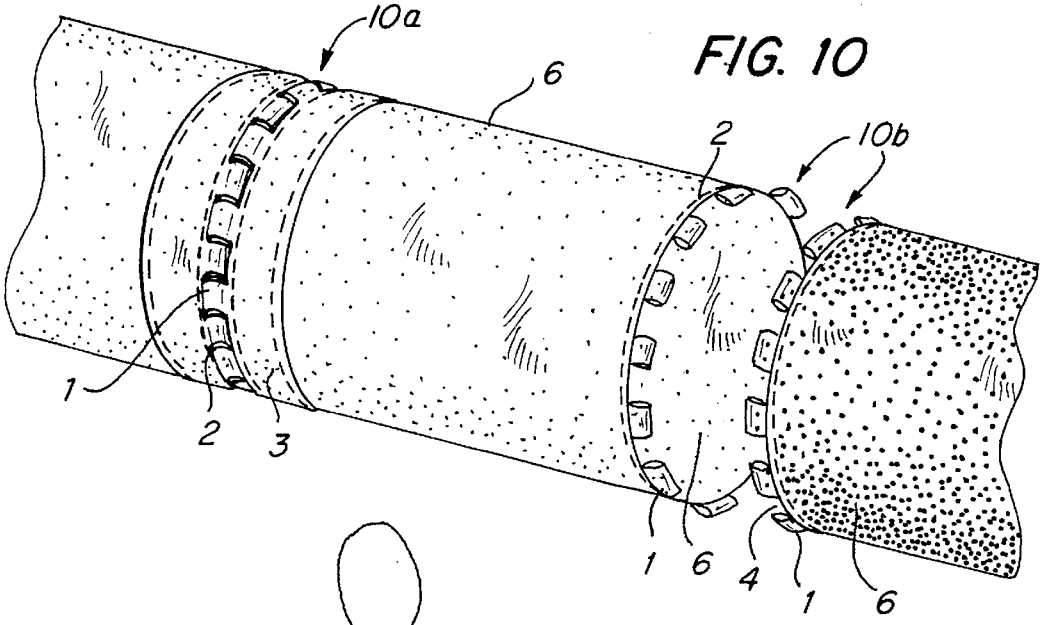

FIG. 10 illustrates the use of the improved flexible hinge connector of FIG. 1 to connect cylindrical cushions, illustrating, at 10*a*, the flange 3 affixed to the exterior surface of the body 6, and, at 10*b*, the flange 3 affixed in a concealed manner such as inside the seam.

Figure 11:
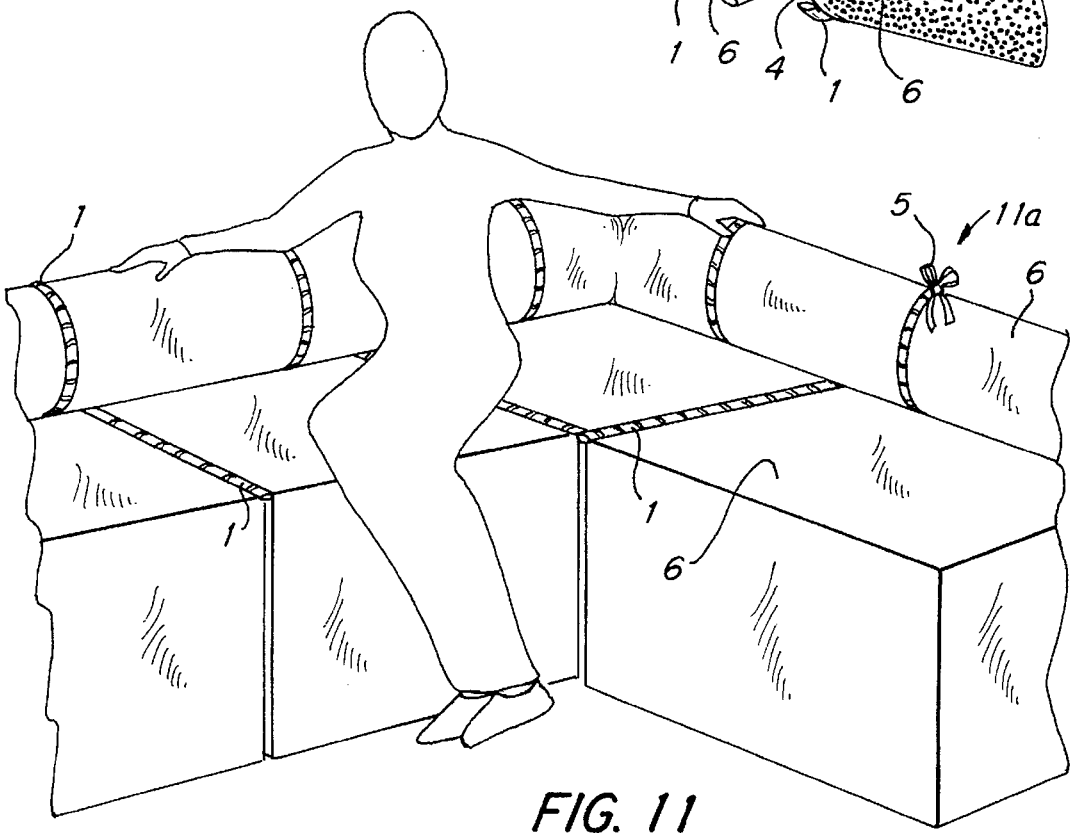

FIG. 11 is a perspective view of a seating arrangement with seating units and cushions connected with lengths of the flexible hinge connector of FIG. 10, illustrating the option of using a length of ribbon, webbing, cord or other flexible stock to join and keep together the loops of the hinge connector attached to and joining two cushions.

Figure 12:
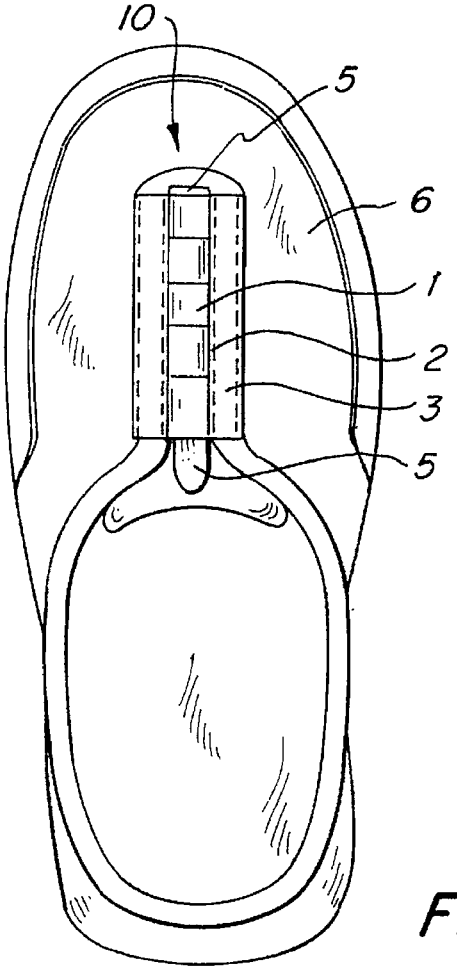

FIG. 12 is a view of the flexible hinge connector of FIG. 1, embodied in a shoe.

Figure 13:
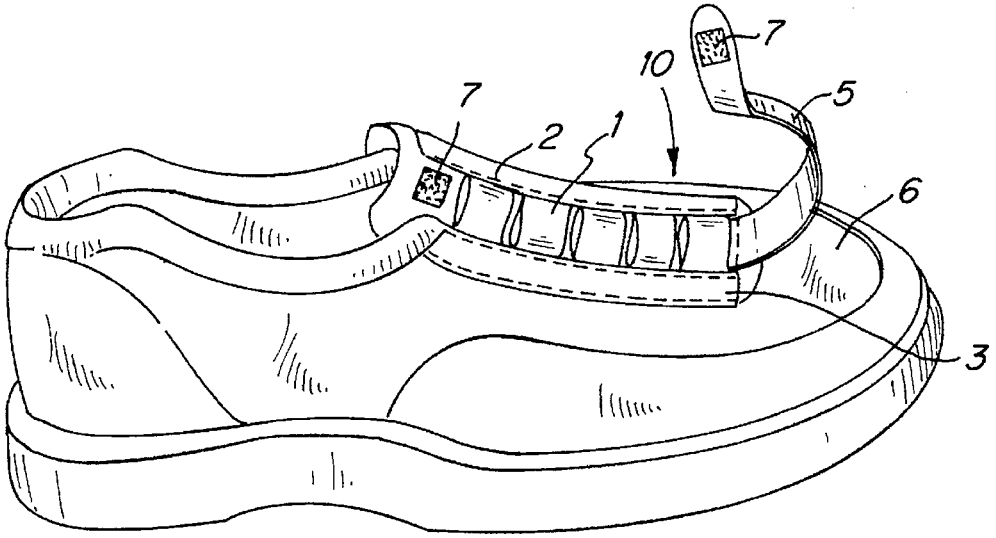

FIG. 13 is a perspective view of the shoe and flexible hinge connector of FIG. 12 showing the linear loop connector member removed from the loop sections.

Figure 14:
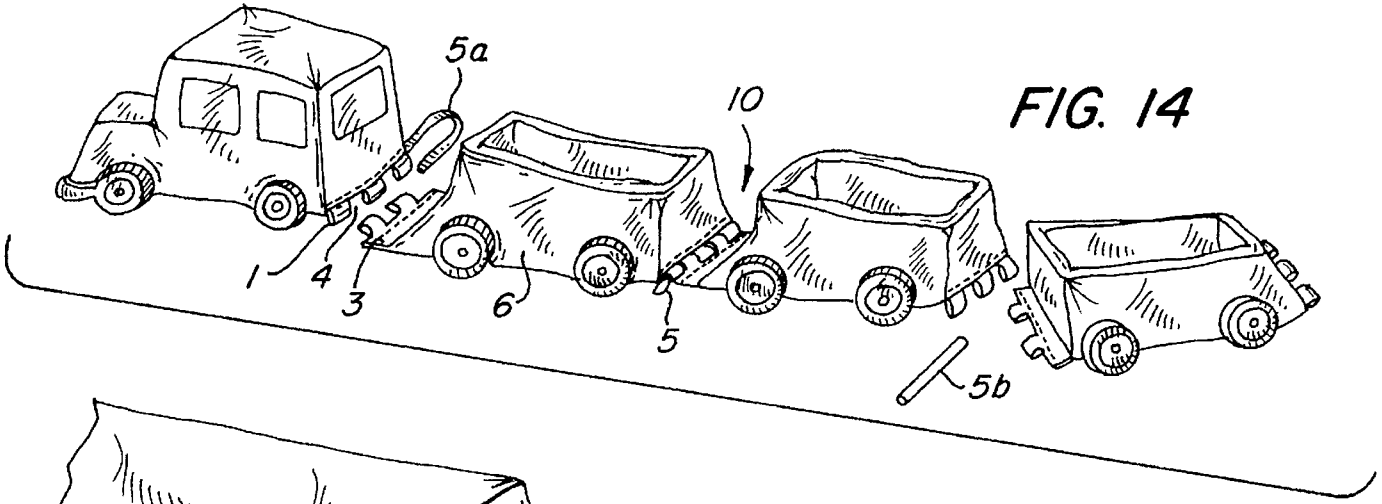

FIG. 14 is a perspective view of a soft-sculpture-type modular toy incorporating the flexible hinge connector of FIG. 1 illustrating the option using a flexible or rigid loop connector.

Figure 15:
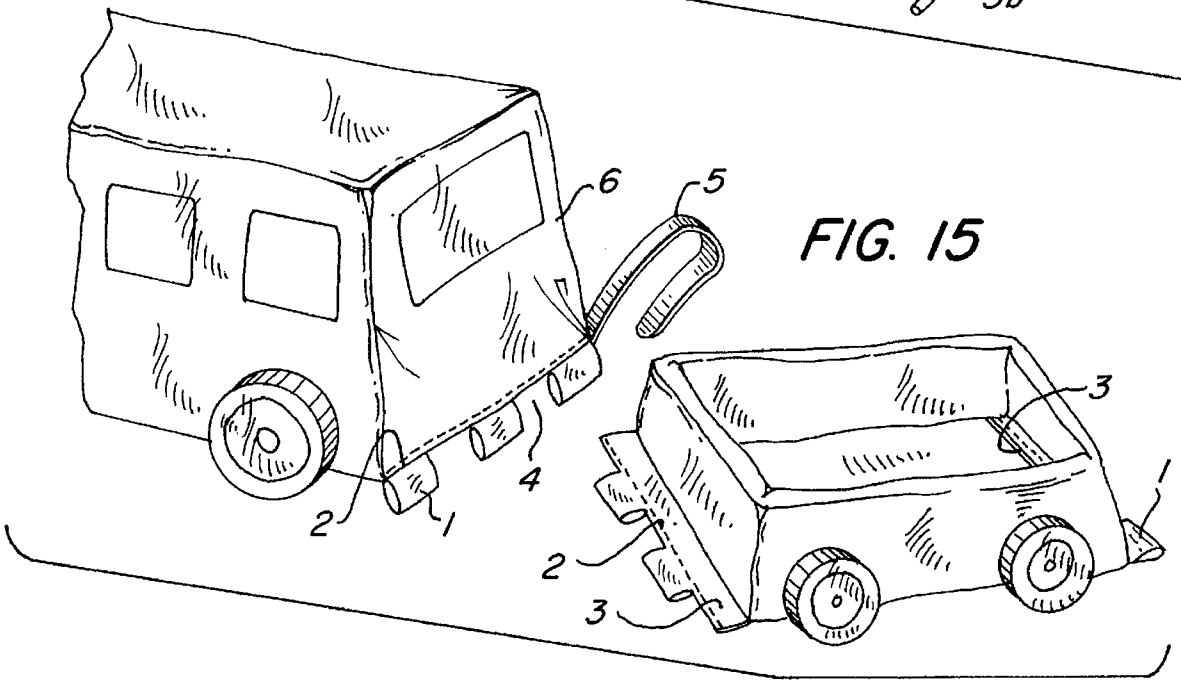

FIG. 15 is a close-up view of the flexible hinge connector of FIG. 14.

Figure 16:
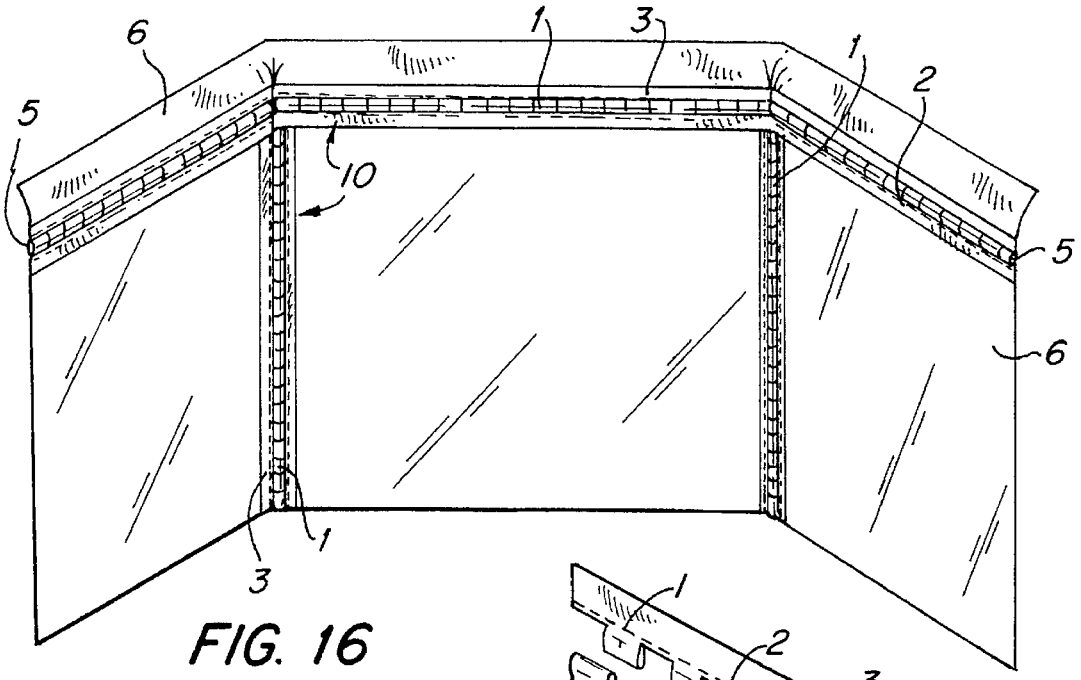

FIG. 16 illustrates the use of the flexible hinge connector of FIG. 1 on clear vinyl windows typical on boats, other vehicles and products such as see-through room enclosures for restaurants.

Figure 17:
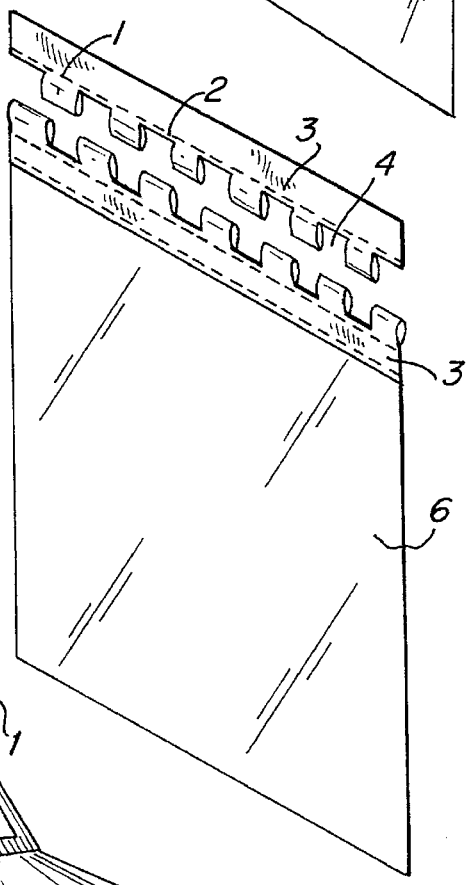

FIG. 17 is an exploded view of the flexible hinge connector of FIG. 16 illustrating the use of clear vinyl material for the hinge components.

Figure 18:
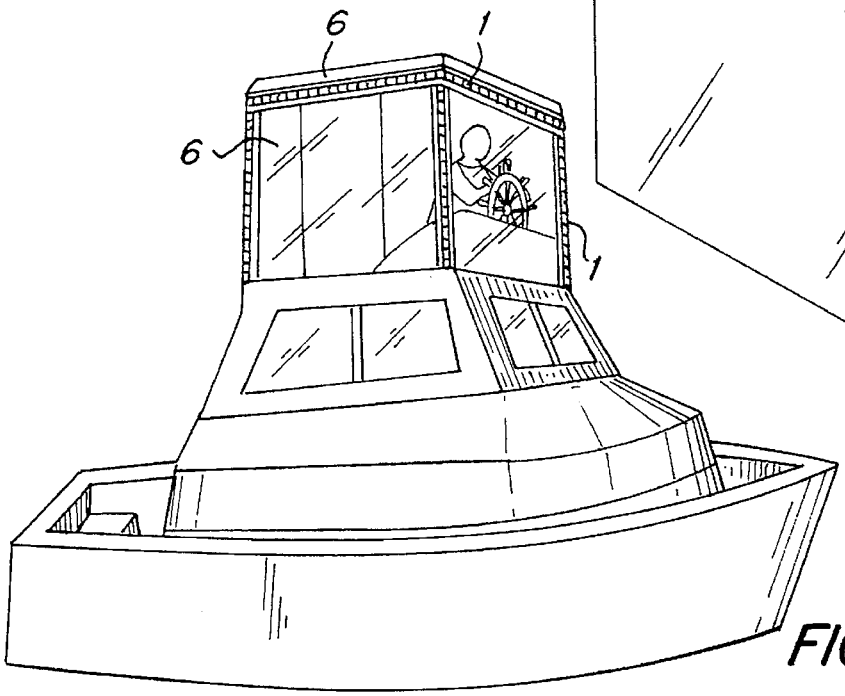

FIG. 18 is a view of a clear vinyl fly bridge enclosure on a boat, assembled with the flexible hinge connector of FIG. 1.

Figure 19:
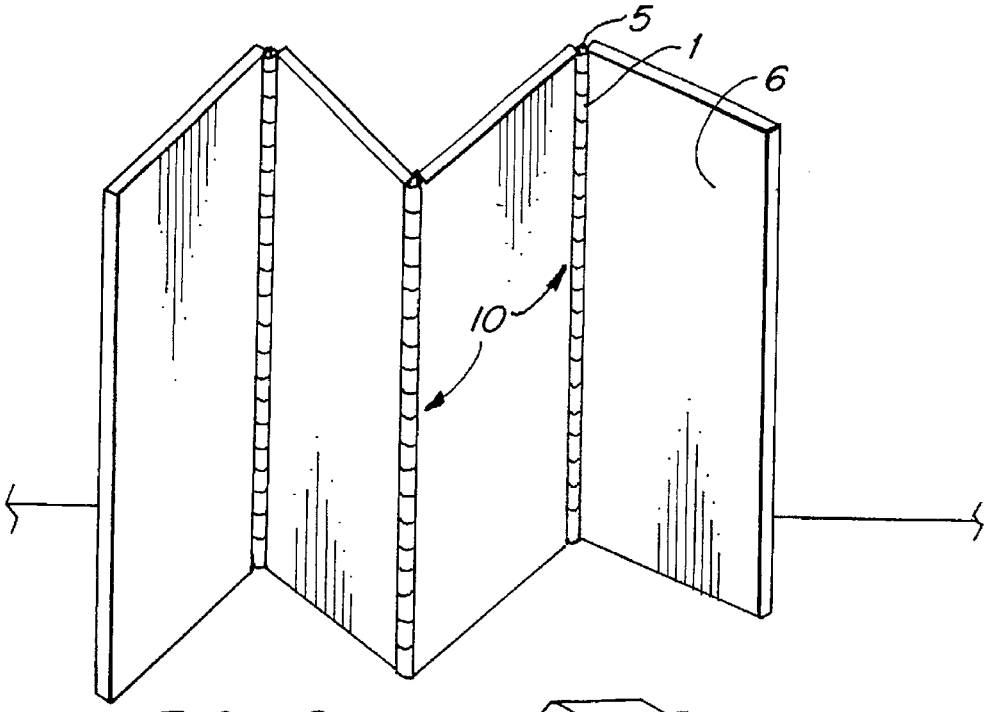

FIG. 19 is a perspective view of the flexible hinge connector of FIG. 1 embodied in a room divider.

Figure 20:
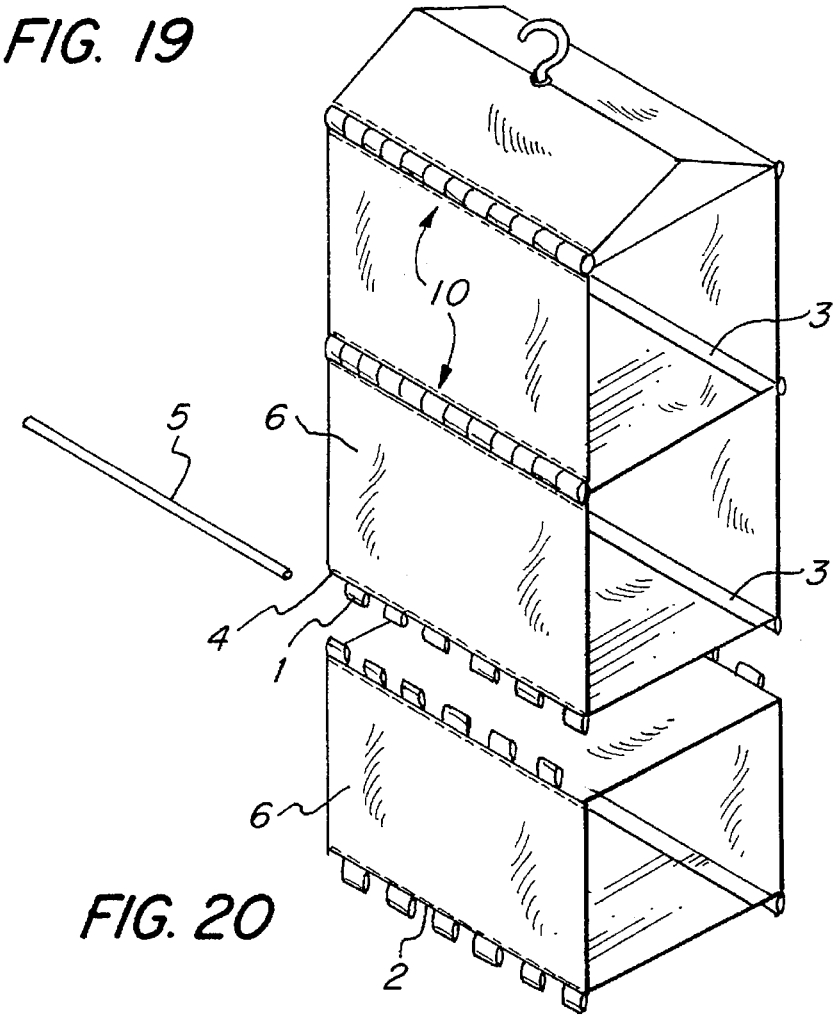

FIG. 20 is a perspective view of the flexible hinge connector of FIG. 1 embodied in modular storage units illustrating the use of a rigid or semi-rigid loop connector.

Figure 21:
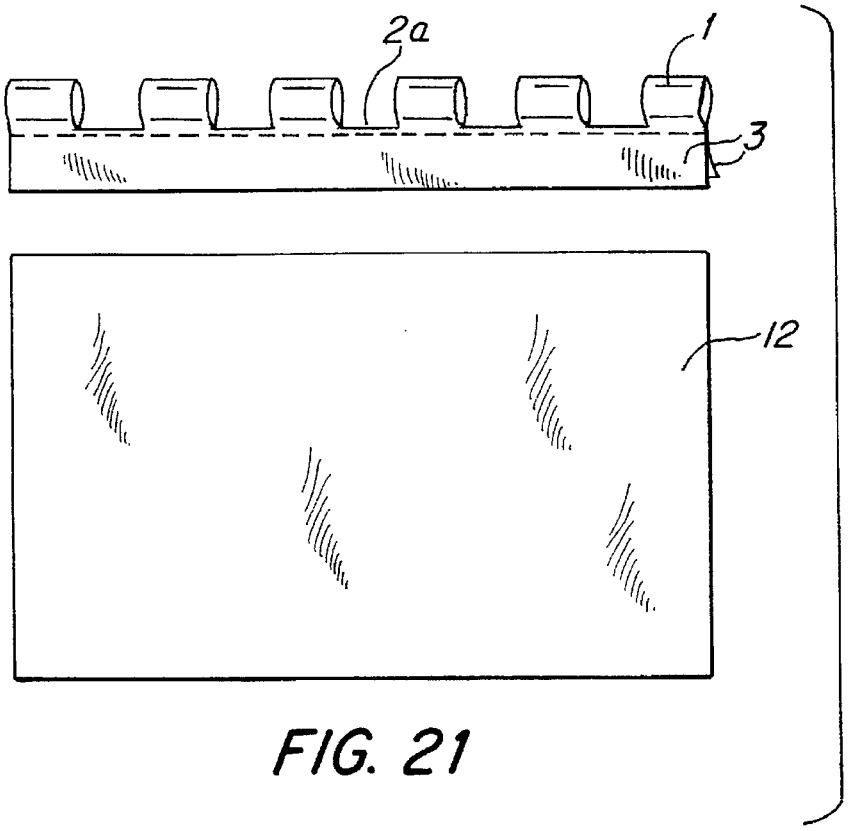

FIG. 21 is an exploded view of a single length of the flexible hinge connector composed of one ply or lamination.

Figure 22:
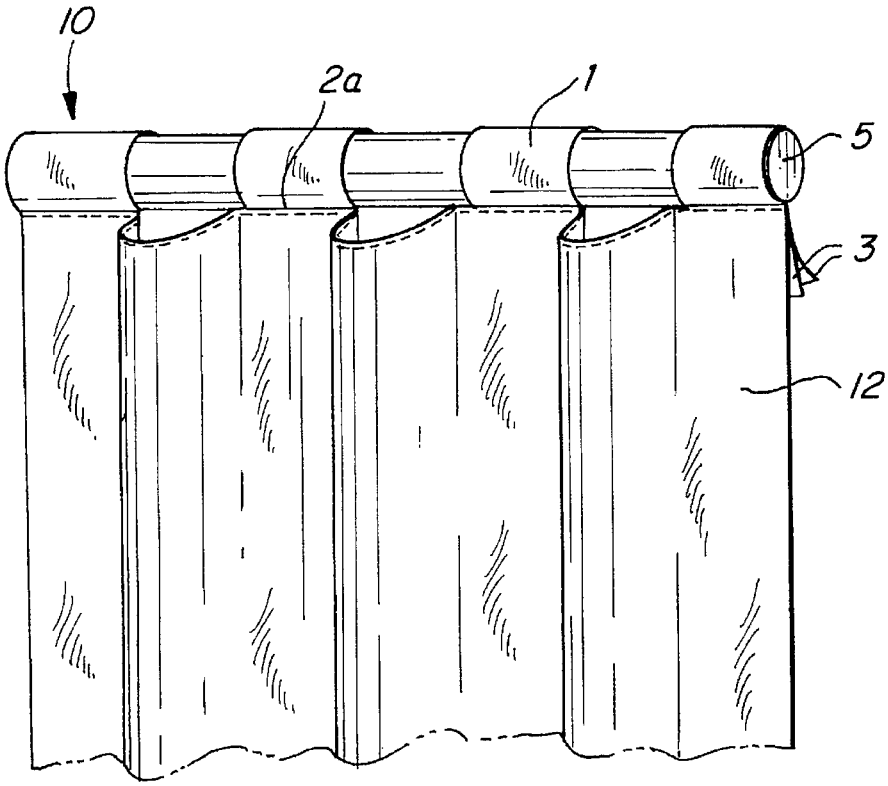

FIG. 22 is a view of a single length of the flexible hinge connector of FIG. 1 attached to one side of the object being connected, such as a curtain, flag, banner or similar embodiment.

FIG. 23 is a top view of a method of creating a flexible hinge connector by separating a sheet of flexible material along a line having two substantially right-angle turns in one direction followed by two substantially right-angle turns in the opposite direction thereby separating the sheet into two panels and simultaneously creating two sets of seamlessly-attached strips.

FIG. 24 is a top view of the method of FIG. 23 illustrating the sets of seamlessly-attached strips.

FIG. 25 is a perspective view of the strips of FIG. 24 illustrating the methods of creating the loops of the flexible hinge connector.

Figure 26:
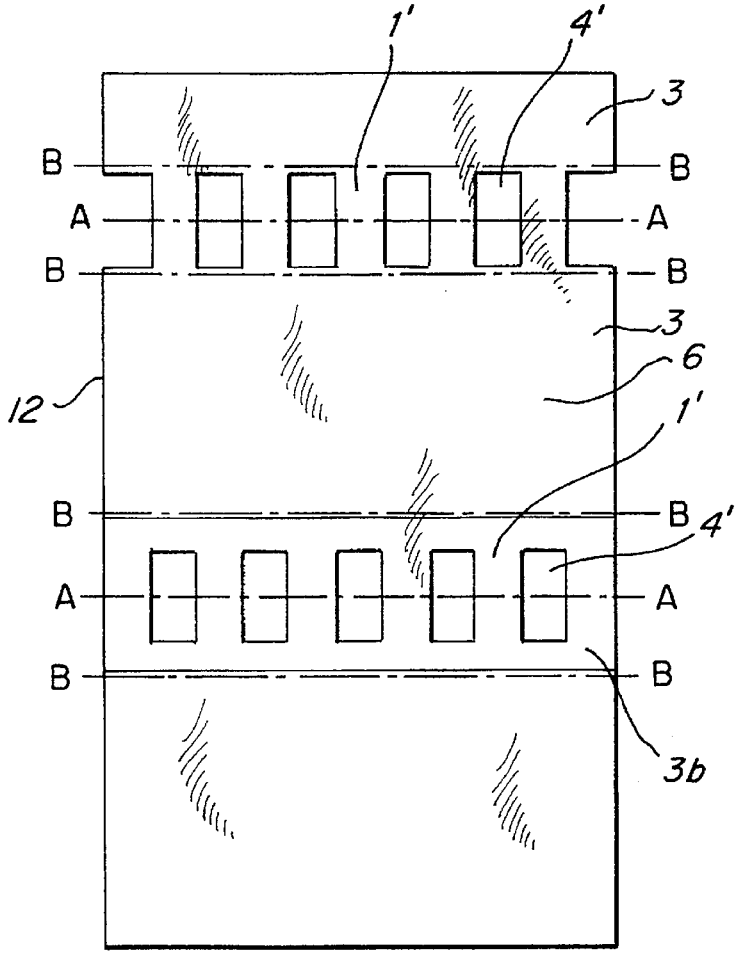

FIG. 26 is a top view of an embodiment of the flexible hinge connector incorporating the flexible hinge connector directly into the object being connected.

Figure 27:
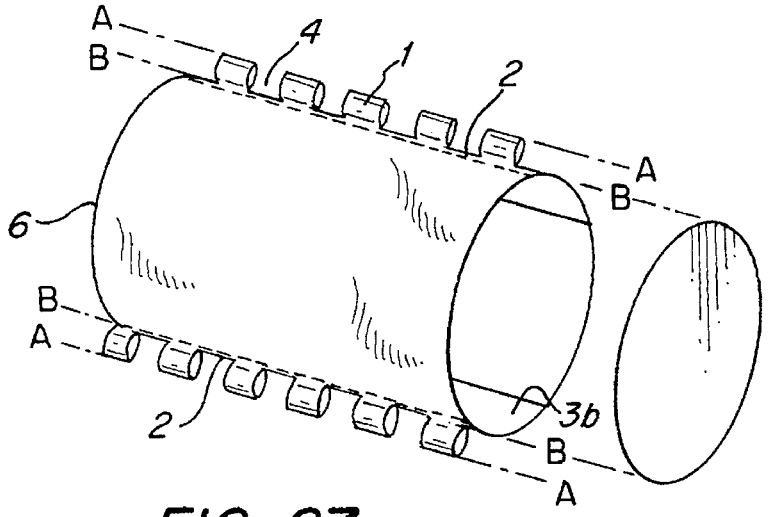

FIG. 27 is a perspective view of the embodiment of the flexible hinge connector of FIG. 26 illustrating its shape when partially assembled.

Figure 28:
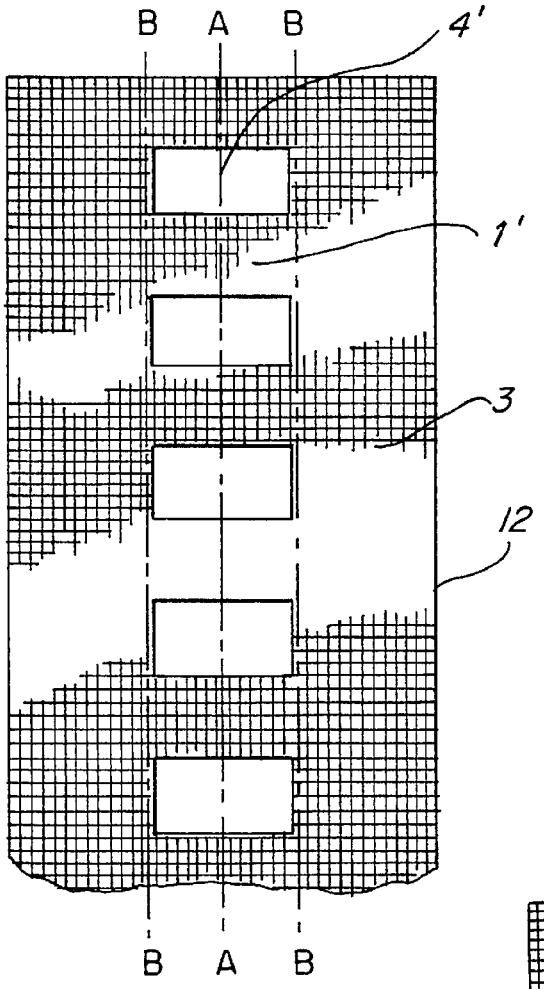

FIG. 28 is a top view of a length of mesh or open weave material with apertures cut or woven at regular intervals for assembly into the flexible hinge connector of FIG. 1.

Figure 29:
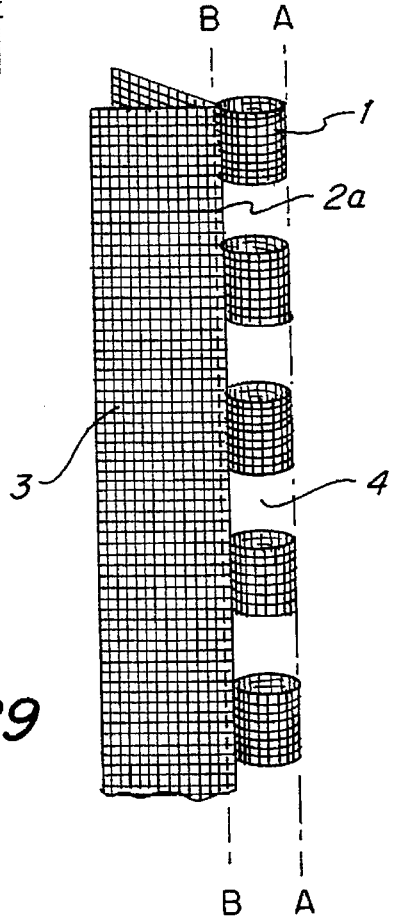

FIG. 29 is a perspective view of the length of material of FIG. 28 illustrating the shape once partially assembled.

Figure 30:
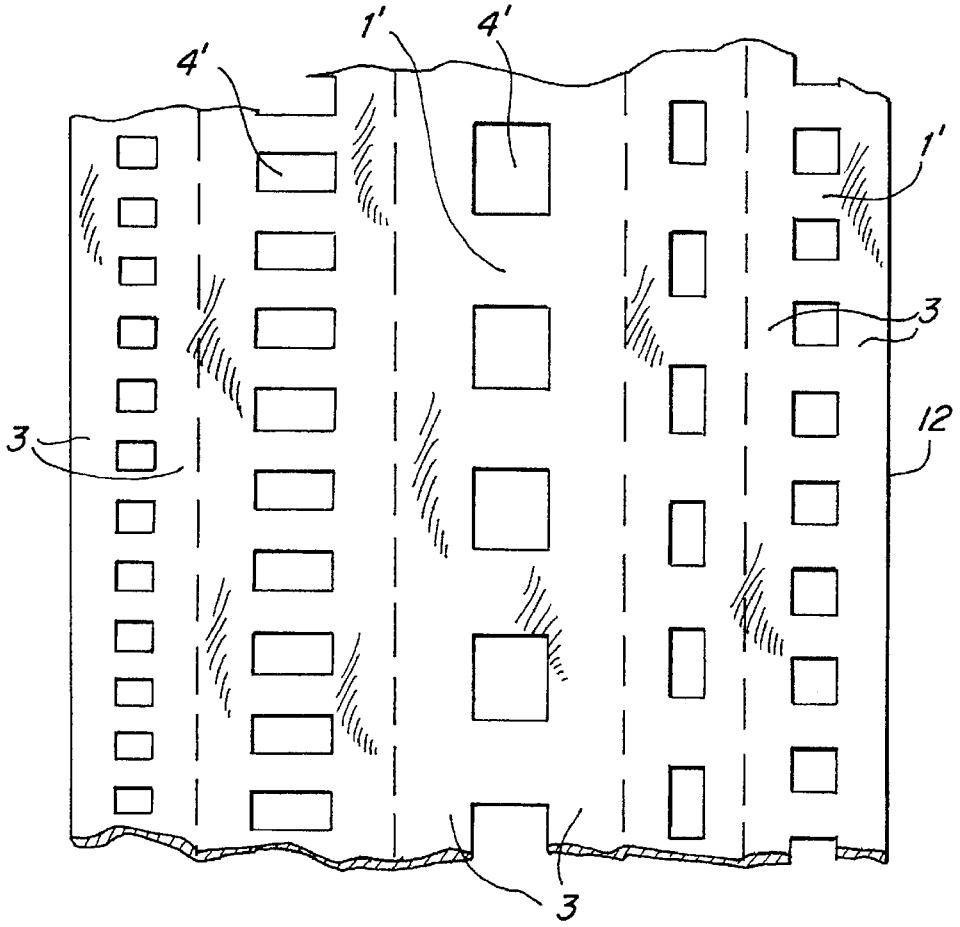

FIG. 30 is a top view of a length of planar material which has five different sizes and widths of flexible hinge connector strips cut from it.

Figure 31:
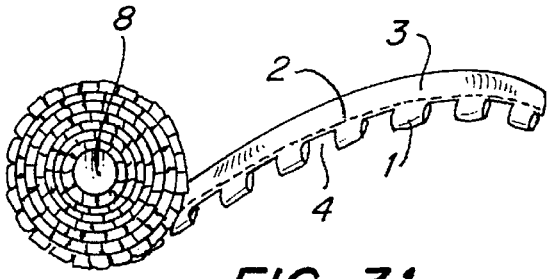

FIG. 31 is a cross-sectional view of a roll or spool of the flexible hinge connector of FIG. 1 illustrating the flexible and compressible nature of the hinge as well as a method of storage and/or display.

Figure 32:
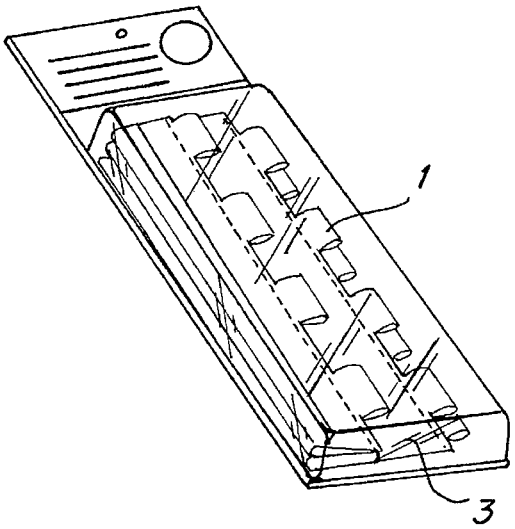

FIG. 32 is a perspective view of a clear bubble pack containing a length of the flexible hinge connector of FIG. 1, illustrating another example of a method of retail display packaging.

Figure 33:
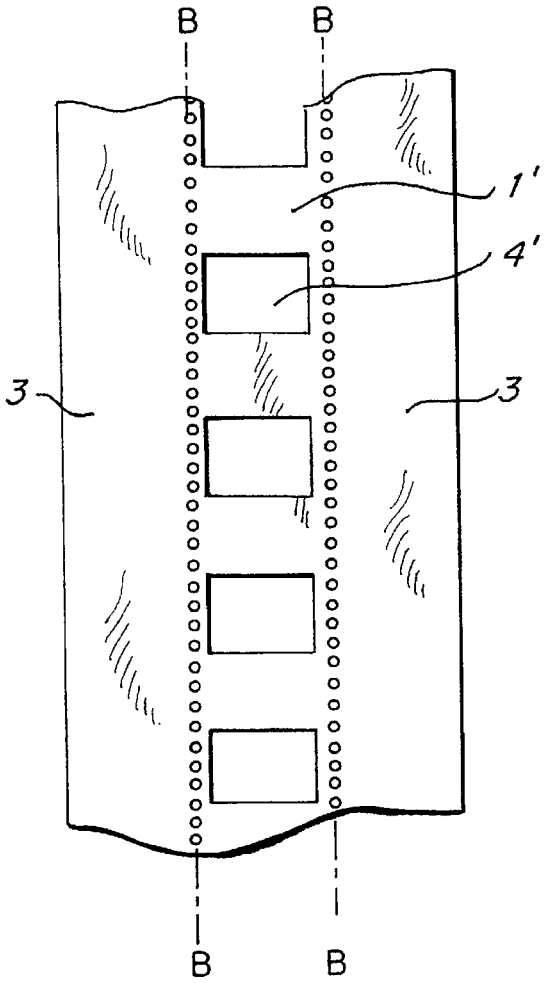

FIG. 33 is a top view of a length of material die-cut for fabrication into the flexible hinge connector of FIG. 1 illustrating the use of rows of small holes along line B—B for attachment.

Figure 34:
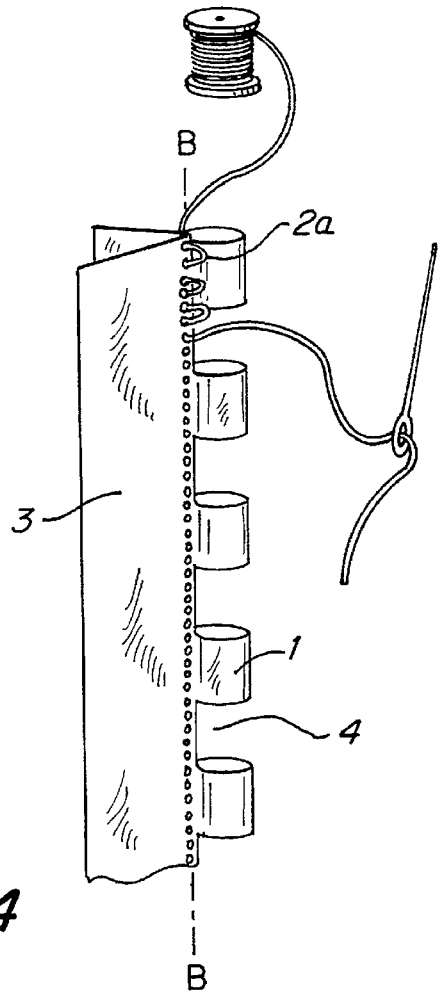

FIG. 34 a perspective view of the length of material of FIG. 33 illustrating hand stitching to secure the loops

DETAILED DESCRIPTION OF THE INVENTION

With reference to FIG. 1, one embodiment of one side of a flexible hinge connector 10 of the present invention is shown comprising two opposing flanges 3 and regularly-spaced connecting loops 1, separated by voids, or apertures 4. An outside layer 3*a* of the flexible hinge connector 10 is comprised of a single piece of flexible material. An interior layer of material 3*b* may be disposed within the outside layer 3*a*. The two opposing flanges 3 and the interior layer 3*b*, if any, may be secured with stitching 2, or with any other suitable method.

Figure 1A:
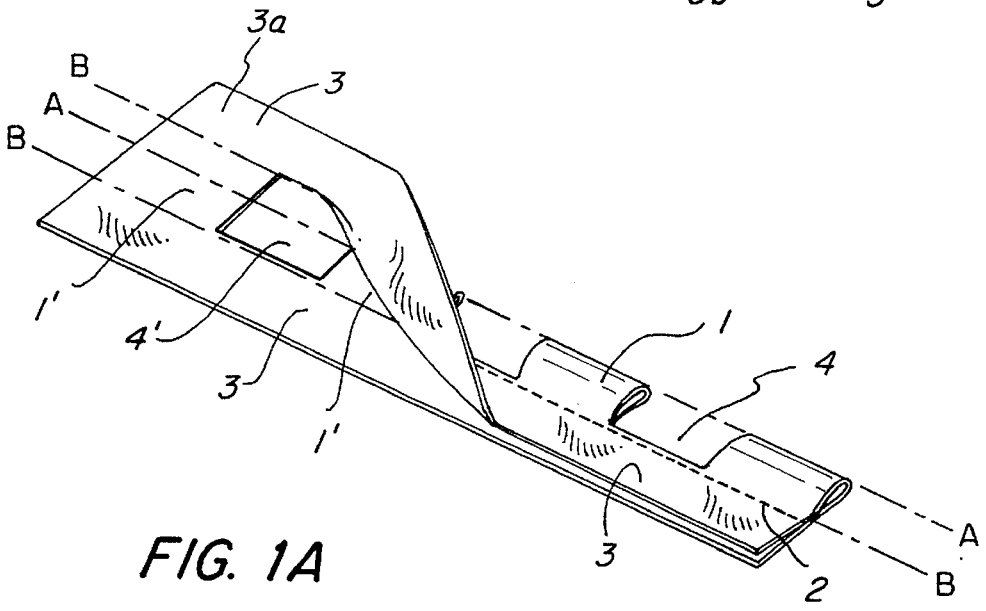

In FIG. 1*a*, a single layer or ply 3*a* includes strips 1' and apertures 4', which create the connecting loops 1 and voids 4 when the layer 3*a* is folded along line A—A.

Figure 2:
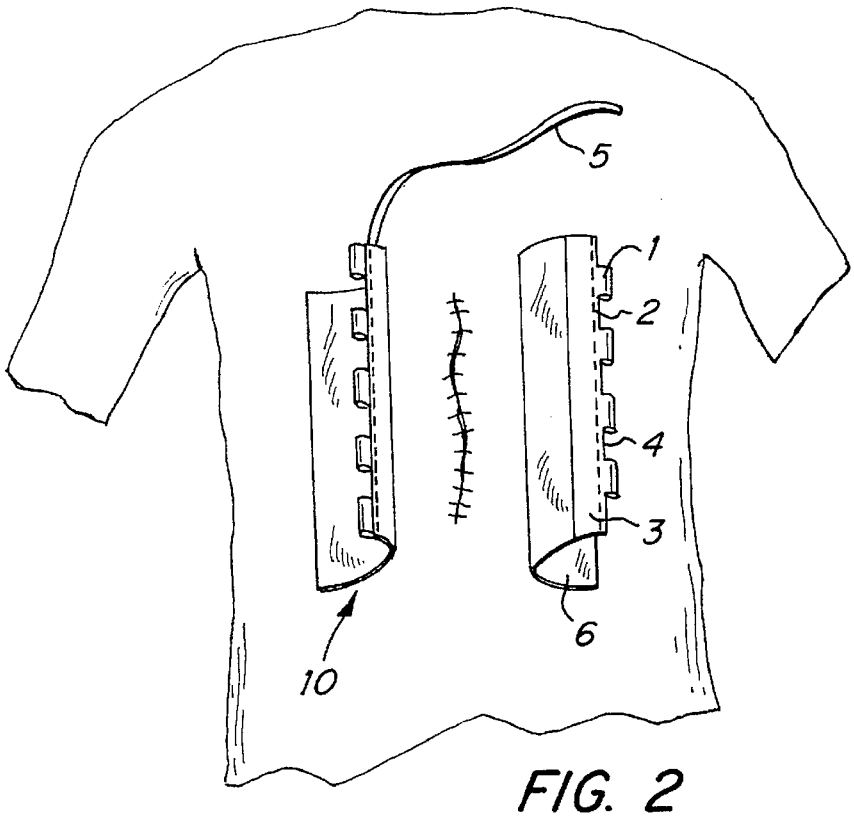
FIG. 2 shows the flexible hinge connector of FIG. 1, in an open position, incorporated in a common medical device used to dress wounds.

In FIG. 2 an embodiment of the flexible hinge connector 10 is shown where the object being connected 6 is a common medical device used to dress wounds. The loop connector 5, here a flexible one, is attached to one side of the device for easy access and to prevent loss.

Figure 3:
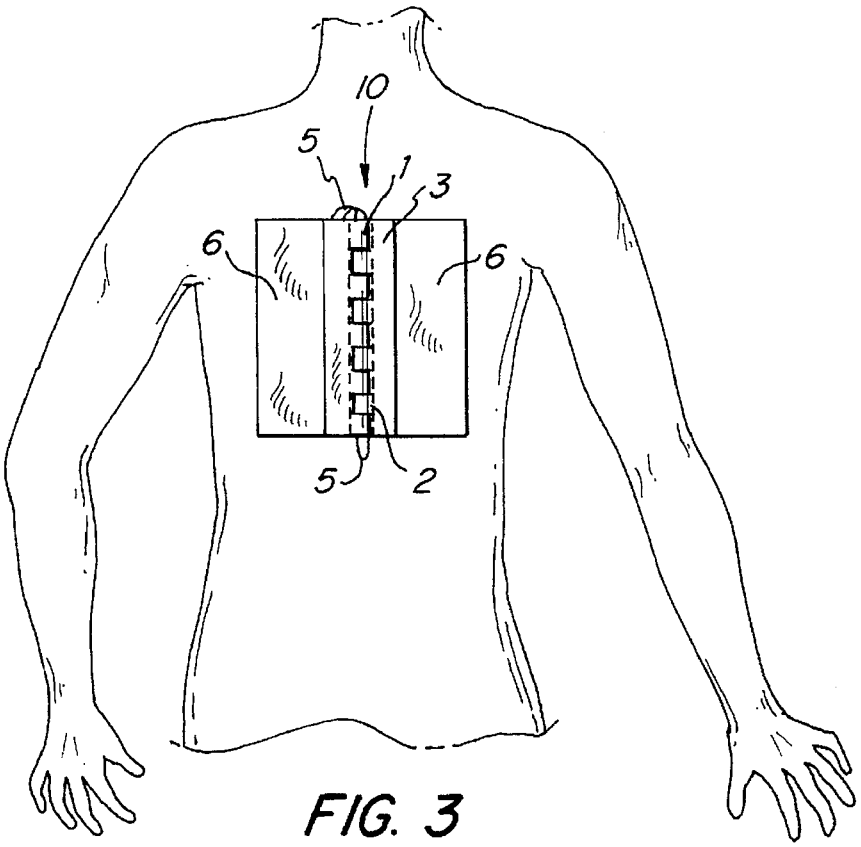
FIG. 3 shows the flexible hinge connector of FIG. 2, in a closed position.

In FIG. 3 the medical device being connected 6 is shown closed with the loop connector 5 inserted through the connecting loops 1, thereby connecting the two sides of the hinge.

Figure 4:
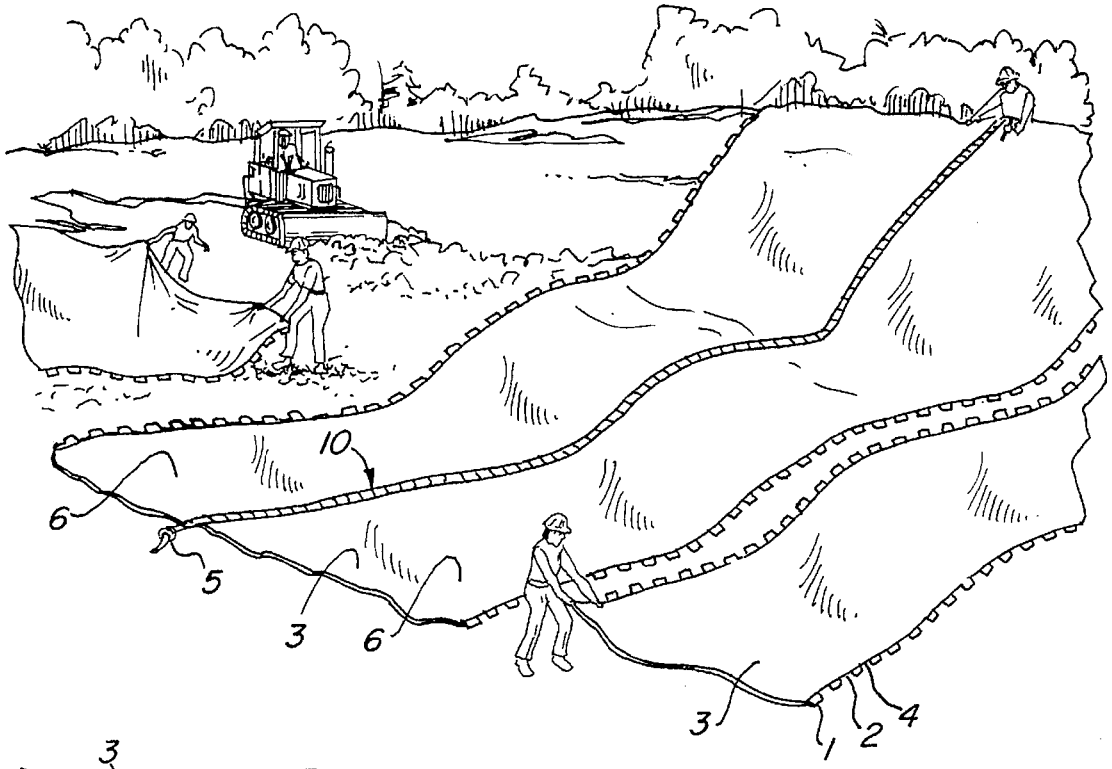
FIG. 4 is a perspective view of the flexible hinge connector of FIG. 1 incorporated in a geotextile material used for erosion control, railroad subgrade stabilization, concert and athletic field covers, and numerous other applications.
Figure 5:
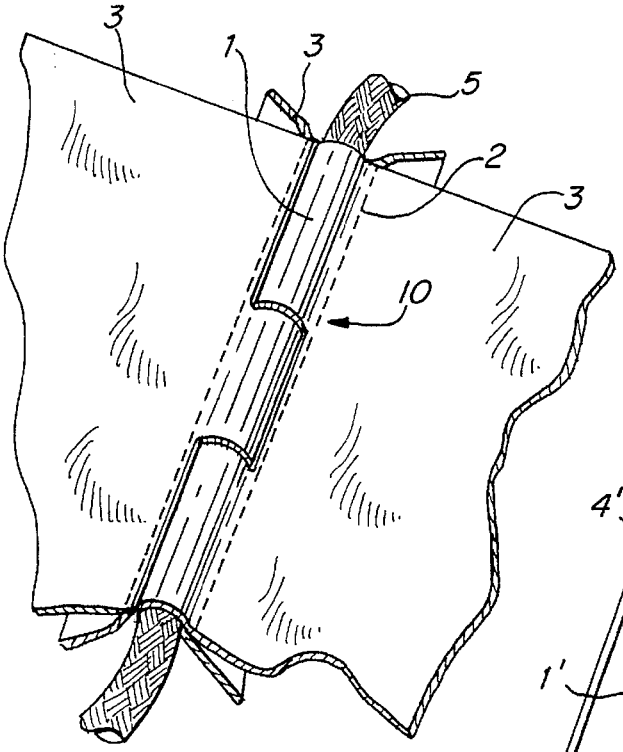
FIG. 5 is a close-up perspective view of the flexible hinge connector of FIG. 4 illustrating the use of flexible rope or cord, 5, as the loop connector.

In FIGS. 4 and 5 the object being connected 6 is a geotextile material used for erosion control, railroad subgrade stabilization, concert and athletic field covers, and other applications and includes a flexible hinge connector 10 joined by a loop connector 5. The loop connector 5 may be made out of a flexible material such as rope thereby allowing the hinge connection to flex, and if necessary compress.

Figure 6:
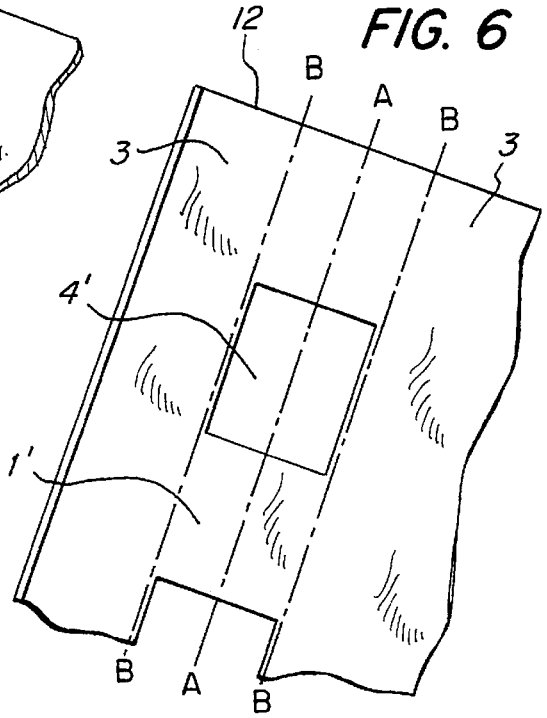
FIG. 6 is a perspective view of the flexible hinge of FIG. 5 showing the method of folding a length of planar material containing regularly spaced apertures along line A—A and securing the circumference of the resulting loops along line B—B with a method and substance suited to the material.

In FIG. 6, a sheet of flexible material 12 forming one side of the flexible hinge connector 10. The sheet 12 includes opposed flanges 3 strips 1' of material and apertures 4'. When the sheet is folded along A—A, the strips 1' and apertures 4' create the flexible loops 1 and voids 4.

Figure 9:
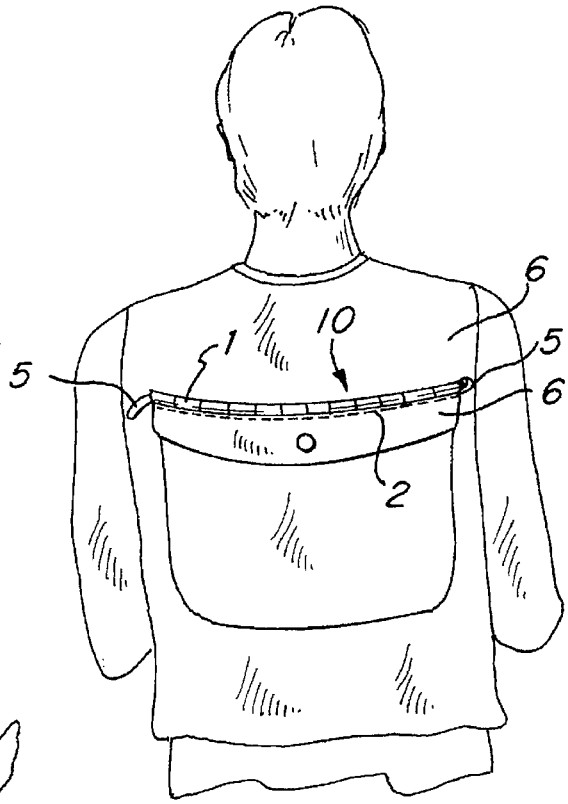
FIG. 9 shows the flexible hinge connector of FIG. 1 attaching a pocket or pouch to the back of a shirt, vest or jacket.
Figure 7:
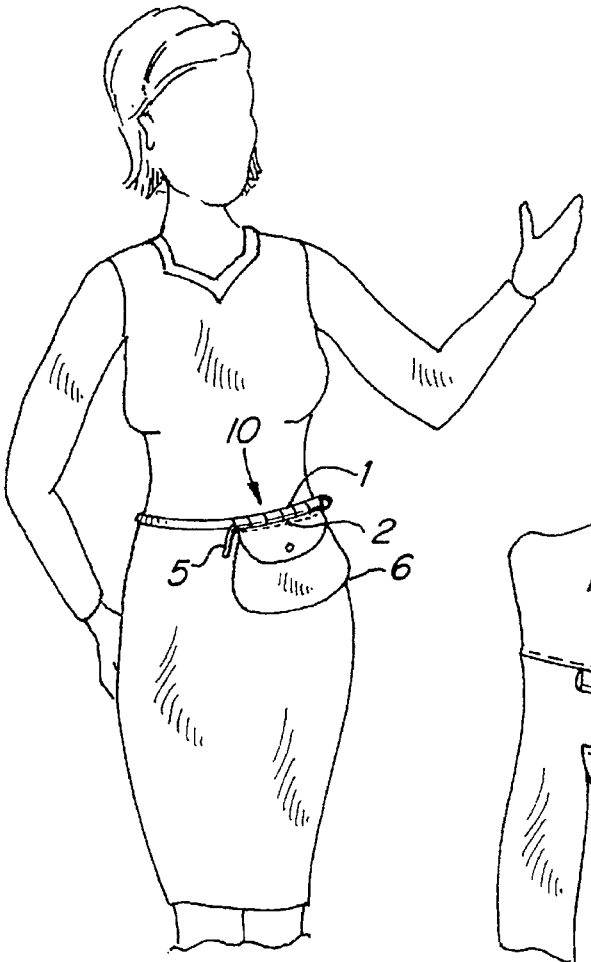
FIG. 7 is a view of the flexible hinge connector used to connect a detachable purse or security pouch to a garment or a belt or sash.
Figure 8:
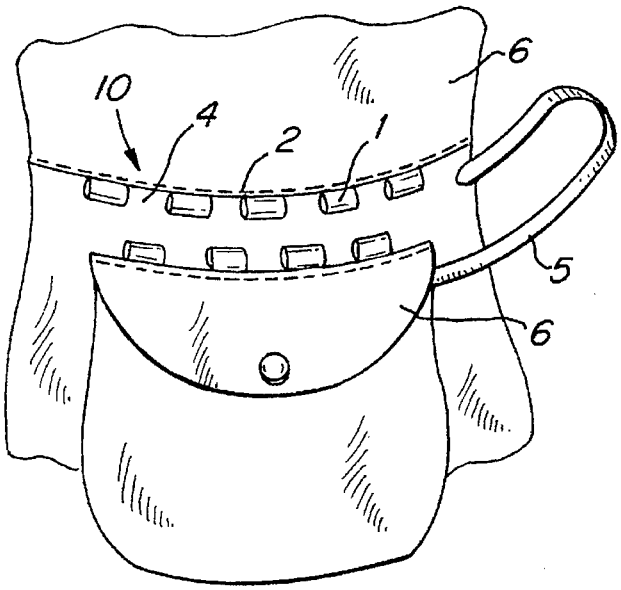
FIG. 8 is an exploded view of the flexible hinge connector of FIG. 7 illustrating the option of the loop connector member being affixed to the object being connected for easy access.

In FIGS. 7, 8, and 9 the flexible hinge connector 10 may be used to connect various objects including a detachable purse or security pouch 6. The loop connector 5 may be affixed to one side of the flexible hinge connector 10 or to the object being connected 6 to prevent loss and for easy access.

In FIGS. 10 and 11, flexible hinge connector 10*a*, 10*b* may be used to connect other objects 6, such as cylindrical cushions. The flexible hinge connector 10*a* may be made from the same material as the object being connected 6. Alternately, the flexible hinge connector 10*b* may be formed a different material and applied to the body of the objects being connected, and the flange portions 3 of the hinge 10*b* concealed, such as within the seam.

In FIG. 11, a flexible ribbon, cord or other material 11*a* is used to interconnect loops 1 of the flexible hinge connector 10.

Referring to FIGS. 12 and 13 a flexible hinge connector 10 containing connecting loops 1 and a loop connector 5 may be affixed to a shoe 6. The loop connector 5 may be affixed to the shoe 6 at one end and, the loop connector 5 and the shoe 6 may include adhesive material 7, such as Velcro, to secure the other end of the loop connector 5 to the shoe 6.

Referring to FIGS. 14 and 15, the flexible hinge connector 10 may be employed to connect soft-sculpture-type modular toys 6. The loop connector may be flexible 5*a* or rigid 5*b*.

Referring to FIGS. 16, 17, and 18, the connecting loops 1 and the opposing flanges 3 of the flexible hinge connector 10 may be made from a single type of material, such as clear vinyl.

Referring to FIG. 19, the improved flexible hinge connector 10 may be used to connect rigid materials such as wood, metal, or other materials such as those found in the frame of a room divider.

Referring to FIG. 20, the flexible hinge connector 10 may be used to connect modular storage units 6 and the loop connector 5 may be made of a rigid, or semi-rigid material.

Referring to FIG. 21, the opposing flanges 3 and the flexible loops 1 of the flexible hinge connector 10 may be independent of the sheet 12 being connected and may be affixed to opposite sides of the sheet 12.

Referring to FIG. 22, one side of the flexible hinge connector 10 and a support 5 acting as a loop connector may be used to support a sheet 12 of material, such as a shower curtain or the like.

Referring to FIGS. 23, 24 and 25, the hinge of the present invention may be made by cutting a sheet 12 of flexible material along a line 14 having two substantially right-angle turns in one direction 16 followed by two substantially right-angle turns in the opposite direction 18 thereby separating the sheet into first and second panels 20, 22 and simultaneously creating two sets of seamlessly-attached strips 1'. The flexible loops 1 may be created by affixing one end of the strip 1' to the panel 20 or 22. This may be done by sewing **25*b*, heat-sealing 25*c*, permanent adhesives 25*d*, pressure-sensitive adhesive 25*e*, hook-and-loop fastener 25*f***, or other method.

Referring to FIGS. 26, 27, 28 and 29, opposing flanges 3 may be created in a sheet of material 12 by creating apertures 4'. The flexible hinge connector 10 with flexible loops 1 may then be made by fastening the opposing flanges 3 in proximity to one another.

Referring to FIGS. 30, 31, and 32 a sheet of flexible material 12 may be die cut to create a number of flexible hinge connectors 10 of various dimensions. A flexible hinge connector 10 may be rolled around itself or a spool 8 for storage in a minimum of space. The flexible hinge connector 10 may also be folded into short lengths for storage or display without any damage.

Referring to FIGS. 33 and 34, the opposing flanges 3 of the flexible hinge connector 10 may be affixed to one another by many methods, including hand sewing.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A flexible connector comprising:

a first flange comprising a section of planar, flexible material;

a first set of loops formed from and integral with said planar, flexible material of said first flange and comprising a first set of strips of planar, flexible material having first and second end portions; and wherein said first and second end portions are fixed in relative positions proximate one another thereby forming said first set of loops;

a second flange comprising a section of planar, flexible material seamlessly attached to said first flange, a second set of loops formed from and integral with said planar, flexible material of said second flange and comprising a second set of strips of planar, flexible material having first and second end portions; and wherein said first and second end portions are fixed in relative positions proximate one another thereby forming said second set of loops;

a flexible and compressible loop connector disposed through and between said first and second sets of loops and alternately passing through a loop of said first set and then a loop of said second set so as to form a single row of loops in a single plane; and said first flange, said second flange, said first set of loops and said second set of loops being movable with respect to said loop connector.

2. A claim as in claim 1 further comprising an opposing flange; said opposing flange comprising a section of planar, flexible material; and said opposing flange being attached to and interconnecting said second end portions of said first set of strips.

3. A claim as in claims 2 wherein said opposing flange is integral and in one piece with said first set of strips and wherein said second end portions of said first set of strips are seamlessly connected to said opposing flange.

4. A claim as in claims 3 wherein said first set of loops, said first flange, and said opposing flange further comprise inside surfaces; and further comprising an inner layer having an outside surface; said inner layer comprising a section of planar, flexible material; and said inside layer being disposed between said first flange and said opposing flange and within said first set of loops; and said outside surface of inner layer being adjacent to said inside surfaces of said first flange, said opposing flange and said first set of loops.

5. A claim as in claim 1 wherein said first flange is integral and in one piece with and is seamlessly connected to an object being connected by said flexible connector.

6. A claim as in claim 5 wherein said opposing flange is integral and in one piece with and is seamlessly connected to said object being connected by said flexible connector.

7. A claim as in claim 1 further comprising an opposing flange; said opposing flange comprising a section of planar, flexible material; and said opposing flange being attached to and interconnecting said second end portions of said first set of strips.

8. A claim as in claims 7 wherein said opposing flange is integral and in one piece with said first set of strips and wherein said second end portions of said first set of strips are seamlessly connected to said opposing flange.

9. A claim as in claim 8 wherein said first flange is integral and in one piece with and is seamlessly connected to an object being connected by said flexible connector.

10. A claim as in claim 9 wherein said opposing flange is integral and in one piece with and is seamlessly connected to said object being connected by said flexible connector.

11. A claim as in claims 8 wherein said first set of loops, said first flange, and said opposing flange further comprise inside surfaces; and further comprising an inner layer having an outside surface; said inner layer comprising a section of planar, flexible material; and said inside layer being disposed between said first flange and said opposing flange and within said first set of loops; and said outside surface of inner layer being adjacent to said inside surfaces of said first flange, said opposing flange and said first set of loops.

12. A claim as in claim 1, said loop connector comprising a rope.

* * * * *